United States Patent [19]

Simmons et al.

[11] 4,401,337

[45] Aug. 30, 1983

[54] INTERLOCK SYSTEM FOR THE LOCKING MECHANISM OF A CARGO CONTAINER LIFTING SPREADER

[75] Inventors: Donald E. Simmons, Emeryville; Raymond H. Barker, Jr., Walnut Creek; Kenneth D. Walter, Foster City, all of Calif.

[73] Assignee: Rigging International Maintenance Co., Oakland, Calif.

[21] Appl. No.: 958,016

[22] Filed: Nov. 6, 1978 (Under 37 CFR 1.47)

[51] Int. Cl.[3] ..... B66C 1/42

[52] U.S. Cl. ..... 294/81 SF

[58] Field of Search ..... 294/81 SF, 81 R, 47 R, 294/67 D, 67 DA, 67 B; 414/608, 620, 621, 738

[56] References Cited

U.S. PATENT DOCUMENTS 3,871,697 3/1975 Bechtloff ..... 294/81 SF 3,885,676 5/1975 Wilson et al. ..... 294/81 SF

*Primary Examiner*—James B. Marbert

*Attorney, Agent, or Firm*—Bruce & McCoy

[57] ABSTRACT

In a cargo container lifting crane employing a lifting spreader for lockingly suspending a cargo container by means of four corner twist locks, an improved electrical interlock system for interlocking the twist lock manual control switch located in the cab of the lifting crane, said interlock system including normally closed, parallel connected proximity switches which are disposed adjacent the twist locks of the lifting spreader and which are connected to a relay whereby the relay is de-energized to close a relay circuit which supplies power to the twist lock manual control switch when all of the four corner proximity switches indicate full engagement of all twist locks into the corresponding locking parts of the cargo container. An adjustable time delay is provided between full lifting spreader engagement and application of control switch power, and a by-pass switch is provided for overriding the interlock system. Also, indicating and alarm lights and horn are provided to alert crane maintenance and supervisory personnel, as well as the crane operator, of certain operating and alarm conditions in respect to the interlock system.

10 Claims, 7 Drawing Figures

INTERLOCK SYSTEM FOR THE LOCKING MECHANISM OF A CARGO CONTAINER LIFTING SPREADER

BACKGROUND OF THE INVENTION

1. Field of the Invention

The present invention is related to cargo container lifting apparatus, and more particularly to the operation of the twist locks of a cargo container lifting spreader, and still more particularly to means for interlocking the twist lock control switch to prevent improper operation thereof.

2. Description of the Prior Art

Cargo containers, which are standardized in size for ease in handling, have in recent years come into widespread use in the shipping industry. Such containers are conventionally handled by lifting cranes which pick up containers with a so-called lifting spreader which is a load spreading lifting device conforming in shape to the top of the container. The spreader locks onto the container by means of corner twist locks which must be aligned and dropped into twist lock receptacle castings built into each of the container's top corners. To move a container, the crane operator first positions the spreader over the container to be lifted such that the twist locks are lined up over the container's corner castings; he then lowers the spreader onto the top of the container whereupon a manual control switch is thrown to rotate the twist lock into a locked position. Similarly, to disengage a spreader from a container which has already been moved, the operator first throws the same control switch to unlock the twist locks and then lifts the spreader away from the container.

Problems arise, however, when the lifting spreader is not properly engaged with the container before the operator turns the manual control switch to close the twist locks. If this happens, which it often does, the twist locks may be rotated against a structural part of the container resulting in damage to the twist lock or the container or both. This situation often occurs because of operator haste which itself is often motivated by a pay formula based on the number of containers an operator handles.

To prevent premature rotation of the twist lock and the resulting equipment damage, interlock systems have been devised to permit rotation of the twist lock only upon proper engagement of the spreader. Conventionally, such interlocks are comprised of a mechanical pressure cam disposed next to each twist lock such that the cam will be depressed to release its associated twist lock when the lifting spreader contacts the top of the container. Such mechanical interlocks, however, have reliability problems and are not suitably adapted to interface with other electrical circuitry of the crane control system. To provide for electrical interlocking of the twist locks, an electrical interlock system has been devised utilizing proximity sensors at the twist locks for sensing the proximity between the lifting spreader and the container. This known system uses, in place of the mechanical cams, proximity switches which are series connected, normally open switches which provide a relay energizing current when all the proximity switches are closed. Upon closing of all the proximity switches of the system, power is supplied to the operator's twist lock manual control switch. It has been found, however, that this electrical interlock system operates irratically, in that, quite often the last in the series of sensors would not operate properly, thereby preventing proper operation of the overall system. It also does not provide the important visual and audio operation controls as will be described in the present invention.

The present invention is an improvement on the above-described electrical interlock system, in that, it overcomes the problem of reliability in respect to sensor operation. It also provides a solution to the over-eagerness problem which occurs with many container crane operators as they proceed through the container lifting operations, namely, engaging a container with a lifting spreader, moving the container to its new location, setting the container back down, and finally disengaging from the container.

SUMMARY OF THE INVENTION

The present invention involves an improved electrical interlock system for the locking mechanisms of a lifting spreader used by a container lifting crane. The locking mechanisms which are controlled would conventionally be twist locks but might include other types of locking mechanisms. The invention is comprised of proximity switches associated with each of the locking mechanisms of the spreader wherein the proximity switches are of the normally closed type. The proximity switches are connected in parallel to provide an energizing current to a relay switching means, the relay circuit of which operatively controls the availability of power to the twist lock manual control switch which is under the control of the crane operator. The normally closed, parallel arrangement of the proximity switches is such that power is supplied to the twist lock manual control switch when the energizing circuit of the relay switching means is de-energized rather than energized. Using the interlock system of the present invention, the reliability problems associated with the operation of the invention's proximity switches is substantially eliminated.

Other aspects of the present invention include means for delaying the time between full lifting spreader to cargo container engagement and power availability to the twist lock manual control switch; they further include means for alerting the crane operator that power has indeed been supplied to the control switch after the time delay. In still other aspects of the present invention means are provided for discouraging the crane operator from prematurely throwing the twist lock control switch to its unlock position when the suspended load is being lowered into position. Also, means are provided to permit the interlock system to be by-passed in the event of a system malfunction and to simultaneously alert nearby crane maintenance personnel of the by-pass so that the malfunction can be corrected at the earliest possible time.

It is therefore seen that the primary object of the present invention is to provide an improved electrical interlock system which reliably operates in field conditions and which directs and encourages the proper operation of the twist locks by the crane operator. Other objects of the invention will be evident from the following specification and claims.

DESCRIPTION OF THE PREFERRED EMBODIMENT

Figure 1:
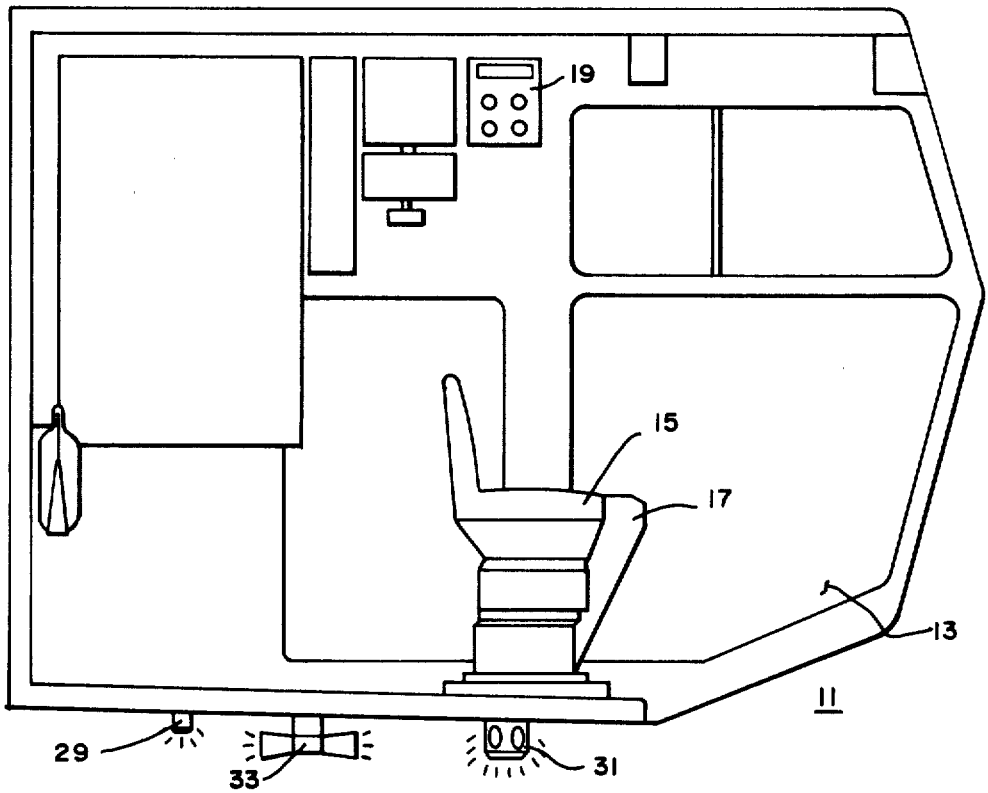
FIG. 1 is a pictorial view of the inside of a conventional operator cab of a container lifting crane, illustrating the location of certain of the operating lights and controls, together with alarm lights and alarm horn.
Figure 2:
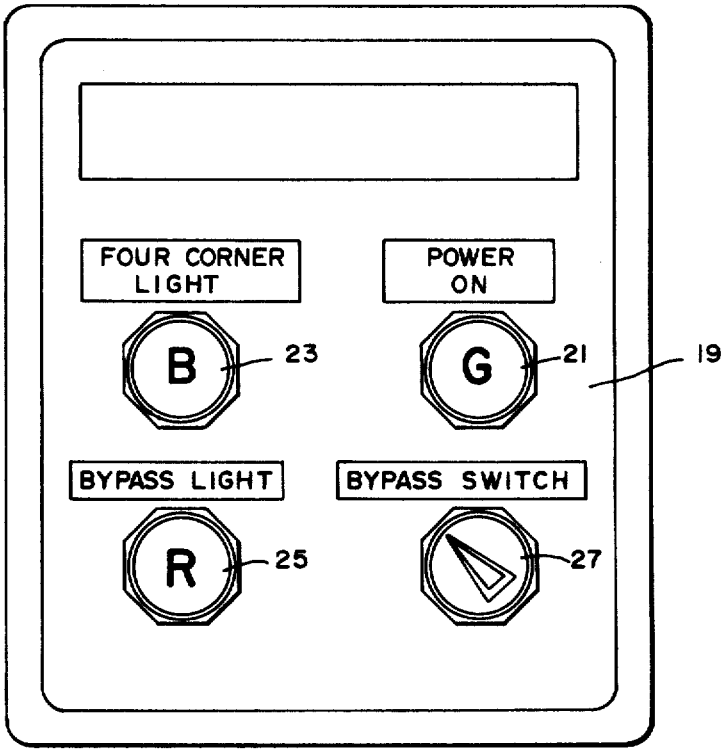
FIG. 2 is a front elevational view of the interlock system control box located in the cab shown in FIG. 1.

Referring now to the drawings, the operator of a container lifting crane conventionally sits in a cab 11 situated near the top of the crane such that the crane operator will have a complete view of his working area through the cab windows, such as denoted by numeral 13. The operator will normally sit in an operator's seat 15 next to which, and within easy reach, there is provided a control panel 17 containing all the necessary controls for operating the crane. Also in the cab 11, and within easy view of the operator seated on the cab seat 15, is a control box 19 containing suitable indicator lights 21, 23, 25, and a interlock system by-pass switch 27, the operation of which will hereinafter be described. The arrangement of the indicator lights and by-pass switch of the control box are most clearly indicated in FIG. 2.

It is noted that located underneath the operator's cab 11 are additional warning lights 29, 31 and an audio horn 33. These alarm mechanisms, which will be more fully described below, are located such that they are easily viewed and heard by crane maintenance and supervisory personnel who are on the ground in the vicinity of the container crane; they particularly provide a highly reliable means of communicating with these personnel with regard to certain aspects of the crane's operation. As will be described, the cab light 29, preferably a red light, acts together with the sounding of the horn 33 to indicate that the operator is operating the crane in a by-pass mode; the yellow and preferably rotating warning light 31, also together with the horn, is used to alert all persons, including the crane operator, that the crane is being operated improperly.

Figure 3:
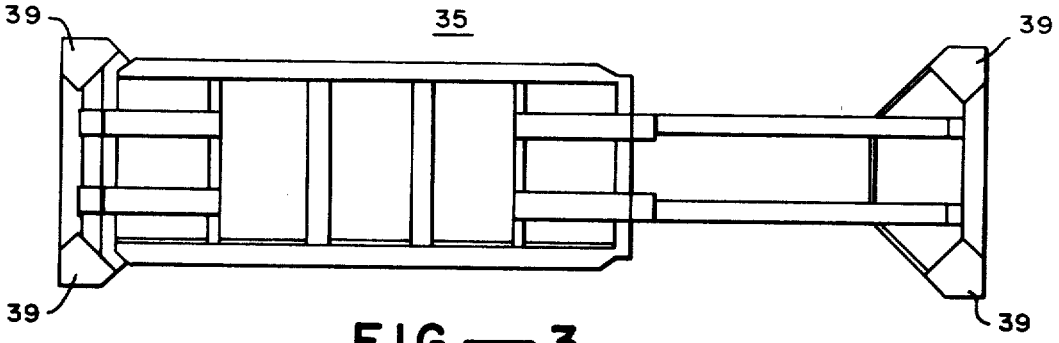
FIG. 3 is a top plan view of a conventional lifting spreader used by a container crane to engage the tops of cargo containers.
Figure 4:
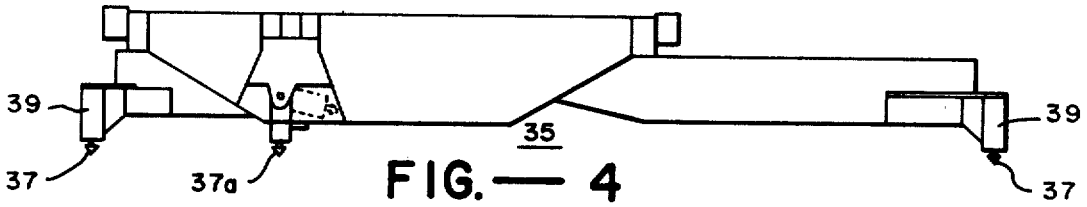
FIG. 4 is a front elevational view of the lifting spreader shown in FIG. 3.

Referring to FIGS. 3 and 4, there is shown a conventional lifting spreader 35 which attaches at the end of the crane's suspension ropes (not shown) as a means for lockingly engaging the cargo container to be lifted. As can be seen, the spreader is rectangular in shape corresponding to the outer dimensions of the top surface of a cargo container, and has locking mechanisms, conventionally twist locks 37, which depend from the four lifting corners 39 of the lifting spreader 35 so that they are capable of engaging corresponding locking parts on the cargo container (not shown). The container locking parts are conventionally corner receptacle castings located in the four top corners of the cargo container at standardized spacings. It is noted that in the industry there are two standardized container lengths and therefore the spreader is designed to be adjustable to these lengths. Also, an additional offset pair of twist locks **37*a*** are retractably mounted to the spreader so that the spreader can be reversed to permit certain close-in lifting operations.

Figure 5:
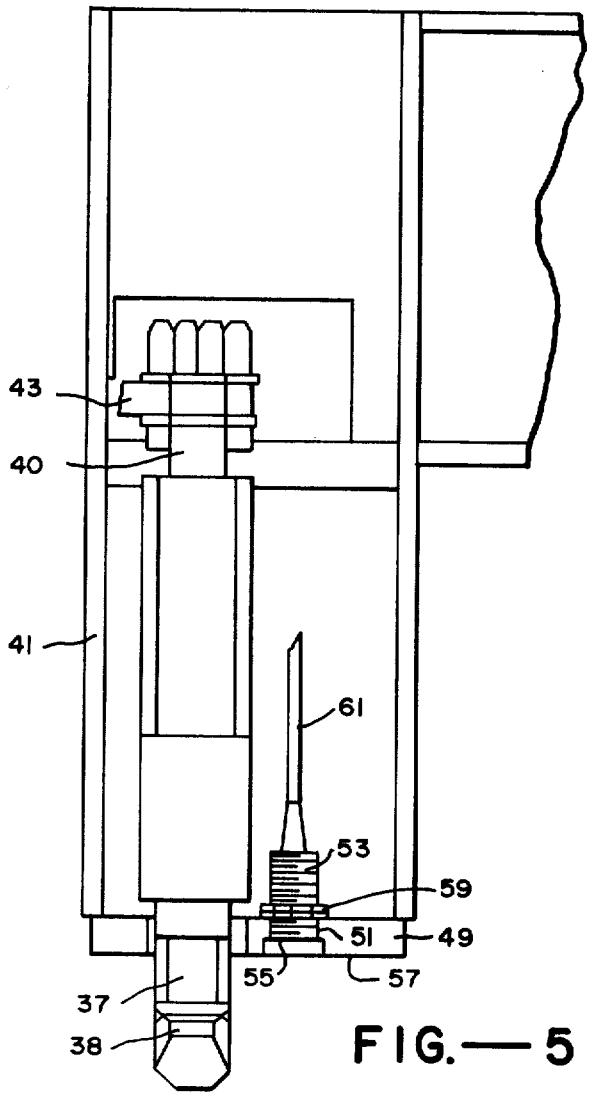
FIG. 5 is a partial cross-sectional view of a corner of the lifting spreader showing the mounting of the spreader's twist lock therein.
Figure 6:
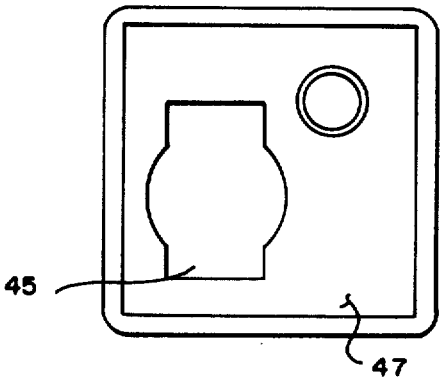
FIG. 6 is a top elevational view of the bottom plate of the lifting spreader corner through which the spreader twist lock protrudes.

Details of the spreader lifting corners 39 with the twist locks mounted therein are shown in FIG. 5 of the drawings. The twist lock 37 has an extended shaft 40 rotatably mounted within the corner structure 41 of the lifting spreader. The twist lock can be rotated through an angle of 90° by means of a remotely rotatable control arm 43 secured to the top of the twist lock shaft 40. In one rotation the twist lock, which has extended tabs 38, is oriented such that it can be lowered into a corner receptacle casting of the cargo container which has a twist lock receiving opening substantially in the shape of the opening 45 shown in FIG. 6; in its opposite rotation the twist lock will be oriented cross-wise with respect to the receptacle opening to firmly lock within the receptacle.

When the lifting spreader 35 engages the top of a cargo container the bottom plate 49 of the spreader's lifting corners 39 contacts the top of the cargo container, and particularly the metal top plate of the cargo container's corner receptacles (not shown). Conventionally, a mechanical cam protrudes through the opening 51 in this bottom plate 49 such that contact with the cam depresses the cam upwardly to interlock the twist lock. In the present invention, proximity switching means are instead provided, preferably by placing a proximity switch 53 in the existing opening 51 in the spreader corner bottom plate 49 of each spreader lifting corner 39. In this position the proximity switches are capable of sensing, by non-mechanical means, the proximity of the container receptacle castings.

The distance between the sensing end surface 55 of the proximity switch and the bottom surface 57 of the container corner's bottom plate 49 is crucial to the operation of the proximity switches and can be set by locking nut 59 through field tests. The switching distance of the particular proximity switch or sensor used should closely correspond to the distance between these two surfaces, 55, 57 whereby switching occurs substantially at the point of contact between the spreader corners 39 and the container corner castings. A TURCK proximity switch, model Berz-G10 having a rated switching distance of 0.393 inches, has been used, with the sensing surface 55 to bottom plate surface 57 spacing being nominially set to 0.39 inches. The proximity switches 53 can be wired through their lead wires 61 to the interlock circuit relays (described below) which are preferably located in the control box 19.

Figure 7:
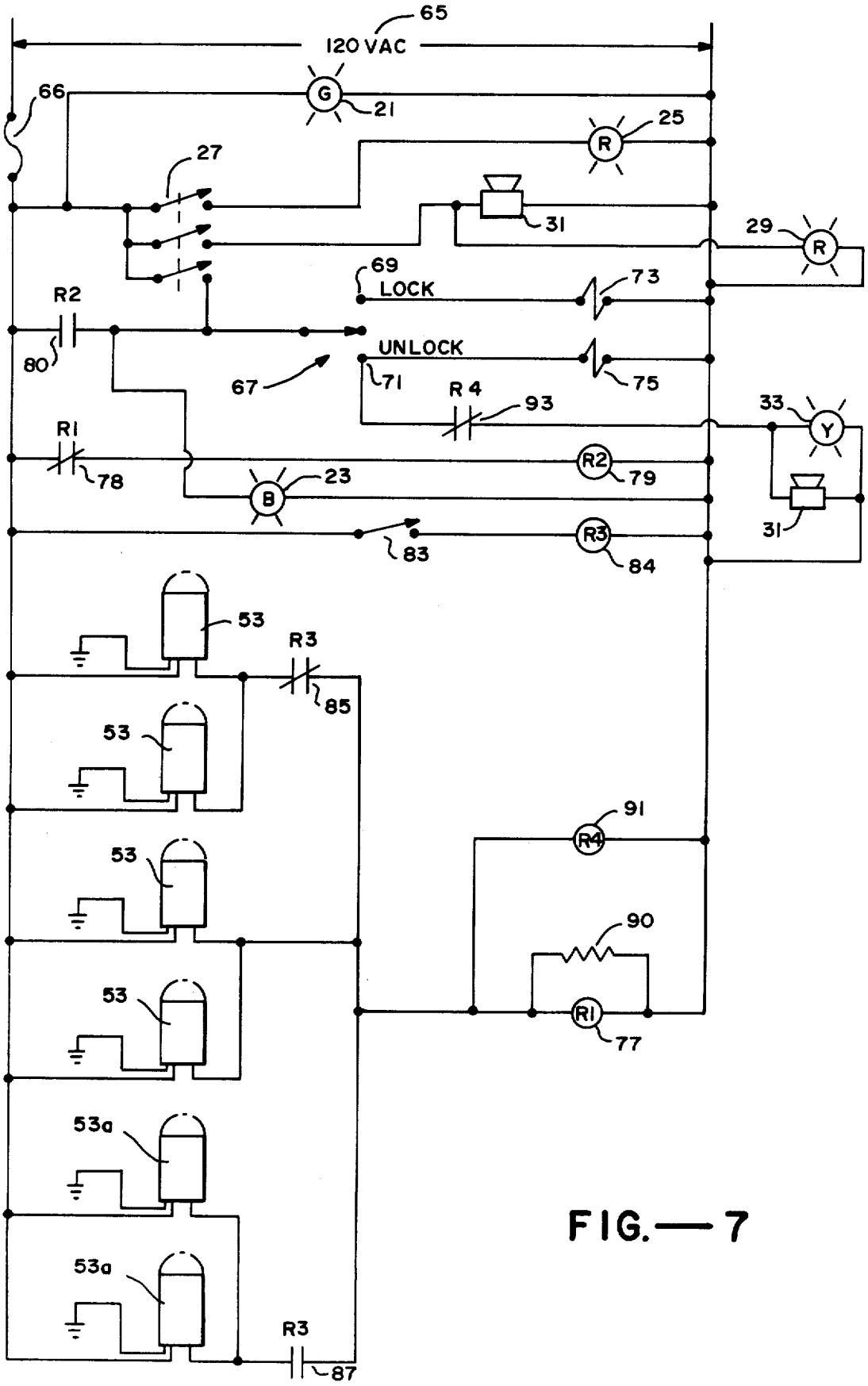
FIG. 7 is a schematic drawing of the electrical circuit of the improved twist lock interlock system of the present invention.

The preferred interlock circuit of the invention is shown in schematic form in FIG. 7 of the drawings. As shown therein, the circuit includes proximity switches 53 and **53*a*, with the proximity switches 53*a* being associated with the offset twist locks 37*a*. It is seen that in this preferred embodiment the circuit is powered through a protection fuse 66 by a 120 volt ac power source 65. The interlock circuitry acts to control the availability of this power to the twist lock manual control switch 67, which is located on the control panel 17 in the crane's cab 11. The manual control switch, which can be conveniently switched to either a lock position 69 or an unlock position 71, permits the crane operator to selectively supply power to the twist locks by means of locking and unlocking control circuits, such as, respectively, solenoid switches 73 and 75. Power to the twist lock manual control switch 67 is interlocked by a relay switching means preferably comprised of the relay R1 connected in tandem with a time delay relay R2. As shown, relay R1 has its energizing circuit 77 connected in series with the proximity sensors 53 and its relay circuit 78 connected in series with the energizing circuit 79 of time delay relay R2; the relay circuit 80 of relay R2 controls the power to manual control switch 67. Thus, the R2 relay circuit 80 is in effect switched in response to a change in the flow of current through the energizing circuit 77 of relay R1, and then only after a delay time which can be preadjusted by adjusting the time delay of relay R2**. Therefore, it can be seen that power will not be supplied to the control switch immediately upon the proper engagement of the lifting spreader with the cargo container, but rather after a preset delay. This will ensure that the crane operator does not hastily throw the twist lock control switch before the lifting spreader is fully settled.

The proximity switches 53 are preferably of a normally closed type which are wired in parallel as shown in FIG. 7. Such an arrangement of normally closed proximity switches means that energizing current will flow through the energizing circuit 77 of relay R1 until all of the proximity sensors used in the circuit sense contact with its associated lifting spreader corner, thus indicating that all four twist locks are properly engaged in the container's corner receptacle castings. When four corner engagement is achieved the energizing current through energizing circuit 77 is prevented from flowing thereby de-energizing relay R1. The relay logic is such that relay R1 is normally closed and time delay relay R2 is normally open in respect to its own energizing circuit 79, but normally closed in respect to the energizing circuit 77 of relay R1. In other words, de-energizing the energizing circuit 77 will cause power to be supplied to manual control switch 67. It is noted that the offset proximity switches 53*a* can replace the top two proximity switches 53 in the interlock circuit by means of a manual offset relay switch 83, which through energizing circuit 84 simultaneously actuates both the normally closed and normally open relay circuits denoted 85 and 87.

It is further noted here that preferably a shunt resister 90 is placed across the energizing circuit 77 of relay R1. It has been found that this resistor, by reducing the bleed current which flows through this energizing circuit, will substantially eliminate any relay chatter or anomalies associated with the bleed current.

A means for indicating the four corner contact of the lifting spreader with the cargo container is provided by the four corner light 23 which is switched on by means of the relay circuit 80 of relay R2. This light, which is preferably located on the control box 19 mounted in the operator cab 11, signals the operator, after a delayed time, that all of the twist locks of the lifting spreader are so engaged with the corner casting of the cargo container as to permit the unobstructed rotation of the twist locks.

Additional unlock condition alarm means are provided to provide a continuing alarm if the operator throws the twist lock manual control switch 67 to its unlock position while a cargo container is suspended by the lifting crane. During suspension, the twist locks, due to the weight of the container, cannot rotate from a locked to an unlocked position. Because of this, crane operators, to speed up operations, commonly throw the control switch 67 before the container is set down, a practice which raises the possibility that a twist lock will prematurely release, such as when a corner of the spreader knocks against a structural part in the hold of a ship. The result is damage to the twist lock and/or the container.

To deter this practice an alarm means, preferably consisting of rotating yellow light 31 and horn 33, are powered through the unlock position 71 of the twist lock manual control switch 67 by means of a normally closed relay R4, the energizing circuit 91 of which, like relay R1, is placed in series with the proximity switches 53. If the proximity switches indicate four corner contact of the spreader with the cargo container and if the control switch 67 is rotated to the unlock position, the relay circuit 93 of relay R4 will energize both the alarm horn 33 and the alarm light 31 located underneath the operator cab 11. The horn is preferably chosen to have a high decibel level to give a clear warning and deterance to the operator concerning the practice of prematurely throwing the control switch 67 to an unlock position before it is time to properly do so, and to incidently alert the supervising personnel that this practice is going on. It is noted that when the load is properly set down such that no weight appears on the twist locks, throwing the manual control switch 67 to its unlock position will cause all the twist locks to unlock, thereby releasing the cargo container from the sensing range of proximity sensor 53 before the alarm light 31 and horn 33 have an opportunity to be activated.

In the event there is a malfunction of any part of the interlock circuit, such as in one of the proximity switches 53, the by-pass switch 27 can be turned to by-pass the relay circuit of relay R2. This directly supplies power to the manual control switch 67. The shown circuit additionally provides that the by-pass switch will energize a by-pass light 25, preferably located on the control box 19, as well as the alarm horn 33 and alarm light 29. Thus, when this by-pass switch is used, the operator, as well as maintenance and supervisory personnel in the vicinity of the crane, will be alerted to the fact that the crane twist locks are being operated in a by-pass condition and that the interlock malfunction which created the need for the by-pass should be attended to immediately. This by-pass alarm scheme will prevent the crane operator from intentionally avoiding the protections provided by the interlock circuits.

As to the operation of the circuit of FIG. 7, it is seen that a crane operator maneuvers and lowers the lifting spreader 35 onto the top of a cargo container until all of the twist locks 37 of the spreader lifting corners 39 are fully engaged into the container's twist lock receptacle castings whereupon normally closed proximity sensors 53 simultaneously de-energize both the energizing circuit 77 of relay R1 and the energizing circuit 91 of relay R4. The normally closed relay circuit 78 of relay R1 thereupon closes to energize the energizing circuit 79 of the time delay relay R2. After its pre-set time delay, the normally open relay circuit of relay R2 closes to supply power to the twist lock control switch 67, simultaneously lighting the four corner indication light 23 located inside the crane's operator cab 11. The crane operator can then throw the manual control switch 67 to its lock position 69 to energize solenoid 73 for rotating the twist locks to a closed position. The manual control switch can also now be rotated to the unlock position for supplying power to solenoid 75. The result is an unlocking force to the twist locks, however, if this force is supplied when the container is suspended and thus before all the twist locks are free to rotate, the alarm 33 and alarm light 31 will be continuously activated through the closed relay circuit 93 of relay R4. If the interlock system malfunctions preventing power to the manual control switch 67, then in order to operate the crane the operator simply throws the by-pass switch 27 at the same time alerting maintenance personnel as to the malfunction condition.

Therefore, it can be seen that the present invention provides an improved electrical twist lock system which provides for the reliable operation of the interlock circuit and which provides suitable alarm and light indication means for promoting the optimum operation of the container lifting crane.

Although the present invention has been described in considerable detail in the foregoing specification, it is not intended that the invention be limited to such detail, except as necessitated by the appended claims.

What we claim is:

1. In a cargo container lifting apparatus employing a lifting spreader which contacts the top of cargo containers for lifting same and which has locking mechanisms for lockingly engaging corresponding locking parts disposed on the top of said cargo container for locking said spreader into contact therewith, and having an interlock system for interlocking the manual control switch which actuates said lifting spreader locking mechanisms so as to prevent premature operator initiated actuation thereof, said electrical interlock system including proximity switching means associated with each of the locking mechanisms of said lifting spreader, and each of said proximity switching means having means for sensing the proximity between said cargo container and said lifting spreader in the area of its associated locking mechanism, the improvement wherein all of said proximity switching mean are interconnected in parallel relation and are normally closed whereby an energizing current is allowed to flow therethrough until all of the proximity switching means of the utilized locking mechanisms of the lifting spreader are actuated to an open condition by the proper contact of the lifting spreader with the top of a cargo container whereupon the flow of said energizing current is prevented, and wherein relay switching means are provided having an energizing circuit and a relay circuit means, said energizing circuit being connected in series with said parallel connected proximity switching means whereby the energizing current controlled by said proximity switching means is permitted to flow therethrough, said relay circuit means being operatively connected for controlling the availability of power to said control switch and being in a normally closed condition in respect to said energizing circuit whereby said control switch is operative until said proximity switching means are actuated to an open condition by suitable contact between said lifting spreader and the top of a cargo container.

2. The improved interlock system of claim 1 further including time delay means for delaying the closure of the relay circuit means of said relay switching means in respect to the de-energizing of the energizing circuit thereof.

3. The improved interlock system of claim 2 wherein said time delay means includes at least one time delay relay forming at least a part of said relay switching means whereby the relay circuit means of said relay switching means closes in response to de-energizing the energizing circuit thereof, but only after the delay time established by said time delay relay.

4. The improved interlock system of claim 3 wherein said time delay relay is a normally open relay, and wherein said relay switching means is formed by a normally closed relay and said normal open time delay relay such that said normally closed relay actuates said normally open time delay relay whereby the relay circuit of the latter is normally closed in respect to the energizing circuit of the former.

5. The improved interlock system of claim 1 wherein said relay switching means is shunted by a resistance so as to reduce the bleed current through said parallel connected proximity switching means.

6. The improved interlock system of claim 1 wherein said locking mechanism control switch has a lock position and an unlock position to which there is connected, respectively, a locking control circuit and an unlocking control circuit, and wherein there is provided an unlock position alarm means connected to the unlock position of said manual control switch, and a second relay switching means having a second energizing circuit and second relay circuit, said second energizing circuit being connected in series to said parallel connected proximity switching means, and said second relay circuit being operatively connected for controlling said unlock position alarm means and being normally closed whereby said unlock position alarm means will be activated if said lifting spreader is fully engaged and locked onto said cargo container and if said manual control switch is turned to its unlock position, and whereby said alarm will continuously be activated unless said manual control switch is turned from its unlock position or said cargo container is in a supported as opposed to a suspended condition which will allow the unlocking of said locking mechanisms and subsequent disengagement of said lifting spreader.

7. The improved interlock system of claim 6 wherein said unlock position alarm means includes an alarm light and alarm horn located on said lifting apparatus for suitable detection by persons in the vicinity of said container lifting apparatus.

8. The improved interlock system of claim 1 further comprising means for bypassing the relay circuit means of said relay switching means whereby power can be supplied directly to said manual control switch to permit an interlock system override.

9. The improved interlock system of claim 8 wherein said bypass means includes a bypass switch, and bypass alarm means, said bypass switch being connected for simultaneously supplying power to said manual control switch and activating said alarm means whereby persons in the vicinity of said container lifting apparatus will be alerted to the bypass condition.

10. In a cargo container lifting apparatus employing a lifting spreader which contacts the top of cargo containers for lifting same and which has locking mechanisms for lockingly engaging corresponding locking parts disposed on the top of said cargo containers for locking said spreader into contact therewith, and having an electrical interlock system for interlocking the manual control switch which actuates said lifting spreader locking mechanisms, said manual control switch having a lock and unlock position and associated locking and unlocking control circuits, said electrical interlock system including proximity switching means associated with each of the locking mechanisms of said lifting spreader, and each of said proximity switching means having means for sensing the proximity between said cargo container and said lifting spreader in the area of its associated locking mechanism wherein said sensed proximity is a valid indication that the spreader locking mechanism associated with the proximity switching means is so engaged with its corresponding locking part of said container as to permit the unobstructed locking and unlocking of said locking mechanism, said proximity switching means being interconnected to switch the energizing current allowed to flow therethrough only when all of the proximity switching means of the utilized locking mechanisms of the lifting spreader are actuated by the proper contact of the lifting spreader with the top of a cargo container, the improvement wherein an unlock position alarm means is connected to the unlock position of said manual control switch, and a relay switching means is provided that is responsive to the energizing current controlled by said proximity sensor means and that is operatively connected for controlling said unlock position alarm means such that said unlock position alarm means will be activated when both said lifting spreader is fully engaged and locked onto said cargo container and said manual control switch is in an unlock position whereby said alarm means will continuously be activated unless said cargo container is in a supported as opposed to a suspended condition which will allow the unlocking of said locking mechanisms and subsequent disengagement of said lifting spreader, and whereby the crane operator, when lowering a suspending container, will be deterred from prematurely throwing said manual control switch to its unlock position.

* * * * *